US005908113A

United States Patent [19]

Takemasa et al.

[11] Patent Number: 5,908,113

[45] Date of Patent: Jun. 1, 1999

[54] POUCHES OF WRAPPING PAPER FOR CONTAINING MEDICINAL DOSES

[75] Inventors: Kazuo Takemasa, Ohta; Manabu Haraguchi, Ohra; Atsuo Inamura, Ohta, all of Japan

[73] Assignee: Sanyo Electric Co., LTD, Osaka, Japan

[21] Appl. No.: 09/026,131

[22] Filed: Feb. 19, 1998

Related U.S. Application Data

[63] Continuation of application No. 08/557,062, filed as application No. PCT/JP95/00519, Mar. 22, 1995, abandoned.

[30] Foreign Application Priority Data

Mar. 22, 1994 [JP] Japan ..... 6-50728
Mar. 22, 1994 [JP] Japan ..... 6-50729

[51] Int. Cl.[6] ..... B65D 83/04

[52] U.S. Cl. ..... 206/530; 206/532; 206/534

[58] Field of Search ..... 206/528, 530, 206/532, 534, 534.1, 534.2, 538, 539, 540, 484, 459.5, 820, 807; 383/204, 207

[56] References Cited

U.S. PATENT DOCUMENTS 3,409,721 11/1968 Applezweig ..... 206/532
3,503,493 3/1970 Nagy ..... 206/534
3,780,856 12/1973 Braverman ..... 206/534
3,809,220 5/1974 Arcudi ..... 206/807
4,398,635 8/1983 Hirt ..... 206/532

*Primary Examiner*—Paul T. Sewell
*Assistant Examiner*—Luan K. Bui
*Attorney, Agent, or Firm*—Darby & Darby

[57] ABSTRACT

An object of the present invention is to prevent a pouch 6 from being broken when it is separated from the rest along a perforation 9 by providing the perforation 9 for separating the pouch 6 and a notch 10 for tearing the pouch, where the direction of said notch intersecting that of the perforation. A sheet of wrapping paper 1 comprises a polypropylene layer and a polyethylene layer formed on a surface of the polypropylene layer for thermal welding. The wrapping paper 1 additionally comprises a printable white layer 4 formed on the other surface of the polypropylene layer and designed to be exposed to the outside when the wrapping paper is longitudinally folded into two halves with the polyethylene layer 3 facing inside. The folded wrapping paper 1 is then thermally welded to produce a plurality of continuously arranged pouches 6 for containing doses. A thermally welded transversal edge section 7 which is perpendicular to longitudinal direction of the wrapping paper has a perforation 9 for the separation of the pouches. A notch 10 is formed at a position along the perforation 9 and in a direction intersecting that of the perforation so that the separated notch can be torn from there.

9 Claims, 3 Drawing Sheets

POUCHES OF WRAPPING PAPER FOR CONTAINING MEDICINAL DOSES

This is a continuation of application Ser. No. 08/557,062, now abandoned, which is a 371 of PCT/JP95/00519 filed Mar. 22, 1995. Each of these prior applications is hereby incorporated herein by reference, in its entirety.

FIELD OF THE INVENTION

This invention relates to pouches of wrapping paper for containing medicinal doses.

BACKGROUND ART

Conventionally, medicinal doses are put into respective pouches of wrapping paper by means of an automatic pharmaceutical wrapping machine according to a prescription so that the patient does not need to sort out doses of different medicines. Pouches of wrapping paper are typically prepared by using cellophane as a base material so that even a physically enfeebled patient may tear them by hand. Such pouches are formed by longitudinally folding an oblong sheet of cellophane coated with thermally weldable polyethylene into two halves, thermally welding the edges of pouches to produce a long series of pouches and perforating along the transversal thermally welded edges to make the pouches separable from each other. Thus, a prescribed number of doses are put into so many unseparated pouches, which are then delivered to the patient. The patient takes in a dose contained in a single pouch, which he or she has torn apart from the rest along the peroration. (See, inter alia, However, since conventional pouches are made of cellophane, care should be taken not to tear somewhere outside the perforation of the pouch to be separated or even of any of the remaining pouches and make a wrong dose fall out of the pouch. If the matter does not go so far, the sealed condition of the doses may be damaged to some extent to make them less preservable.

In view of the above identified problem, it is therefore an object of the present invention to provide pouches of wrapping paper for containing medicinal doses, with which the above problem is solved by diverting the line of separation of each pouch from the line along which it is torn apart from the rest so that it may not be broken when it is separated from the rest along the perforation and each of which can be easily torn to take the dose contained therein.

It is another object of the present invention to provide wrapping paper for forming pouches for containing medicinal doses, each of which can be easily opened to take the dose contained therein by displaying a direction intersecting the line of perforation.

DISCLOSURE OF THE INVENTION

According to an aspect of the invention, there are provided pouches of wrapping paper for containing medicinal doses, characterized in that an oblong sheet of polypropylene is folded longitudinally into two halves, thermally welded along transversal partitioning edges to produce a series of pouches for containing doses and perforated along the thermally welded transversal edges of the pouches and each of the pouches is provided with a torn portion for tearing it along a direction intersecting the perforation formed along a thermally welded transversal edge of the pouch to define the line of separation thereof.

According to another aspect of the invention, there are also provided pouches of wrapping paper for containing medicinal doses of the above described type, wherein each of the pouches is provided with a torn portion for tearing it along a direction intersecting the perforation formed along a thermally welded transversal edge of the pouch to define the line of separation thereof at a position displaced from the center of the line of separation.

According to still another aspect of the invention, there are provided pouches of wrapping paper for containing medicinal doses of the above described type, wherein each of the pouches is provided with a V-shaped or a linear slit for tearing it along a direction intersecting the perforation formed along a thermally welded transversal edge of the pouch to define the line of separation thereof.

According to still another aspect of the invention, there are provided pouches of wrapping paper for containing medicinal doses of the above described type, wherein each of the pouches is provided with a torn portion for tearing it along a direction intersecting the perforation formed along a thermally welded transversal edge of the pouch to define the line of separation thereof and a guide mark printed close to the torn portion for leading a tearing action.

According to a further aspect of the invention, there are provided pouches of wrapping paper for containing medicinal doses, wherein an oblong sheet of polypropylene is folded longitudinally into two halves, thermally welded along transversal partitioning edges to produce a series of pouches for containing doses and perforated along the thermally welded transversal edges of the pouches, and the perforation of each of the pouches shows a zigzag line formed as a combination of V-shaped sections.

As described above, an oblong folded sheet of wrapping paper is thermally welded and perforated at regular intervals along transversal lines to produce a number of continuously arranged pouches, each of which can be separated along the perforation without the risk of tearing the pouch itself and, once a pouch is separated from the rest, it can be easily torn in a direction intersecting the perforation.

In addition, such a slit is formed at a position displaced from the center of the perforation so that the dose contained in the pouch may not fall out when it is torn.

Still further, such a torn portion is formed as a V-shaped or a linear slit so that a notch is formed as the pouch is separated from the rest along the perforation in order to make it even easier to tear the pouch.

Still preferably, a guide mark is arranged close to the torn portion so that the patient may surely tear the pouch along a direction intersecting the perforation.

Pouches of wrapping paper for containing medicinal doses according to the invention and having respective perforations may be even more advantageous and free from inadvertent and mistakenly conducted tearing if the perforation shows a zigzag line formed as a combination of V-shaped sections.

BEST MODE FOR CARRYING OUT THE INVENTION

Now, the present invention will be described by referring to the accompanying drawings.

Figure 1:
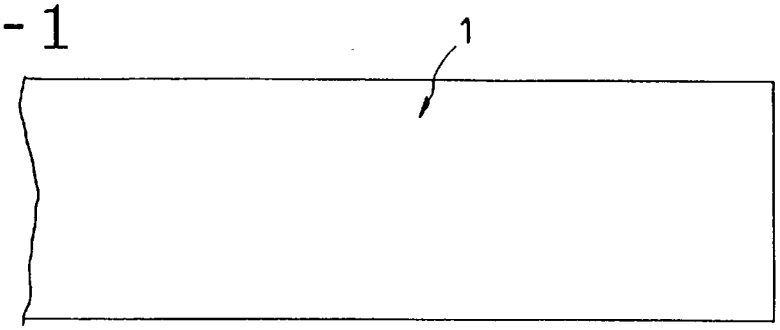
FIG. 1 is a plan view of an oblong sheet of wrapping paper to be used for preparing an embodiment of pouches according to the invention.
Figure 2:
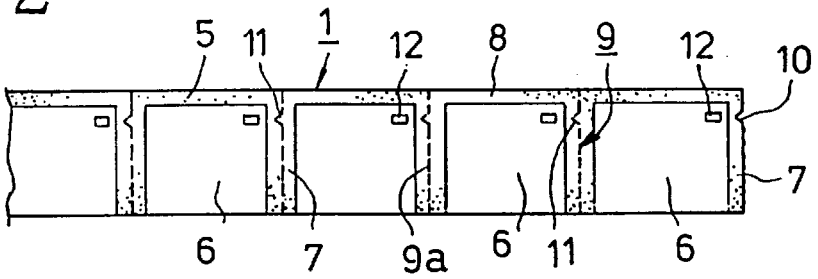
FIG. 2 is a plan view of the finished embodiment produced by longitudinally folding the sheet of wrapping paper to two halves and welding them.
Figure 3:
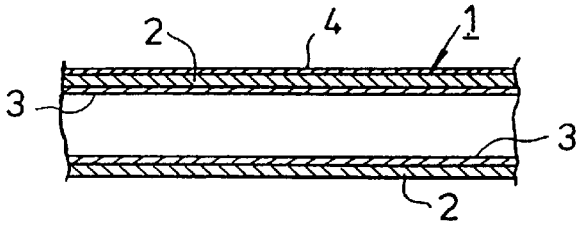
FIG. 3 is a partial cross sectional view of the embodiment, showing an principal area thereof.
Figure 4:
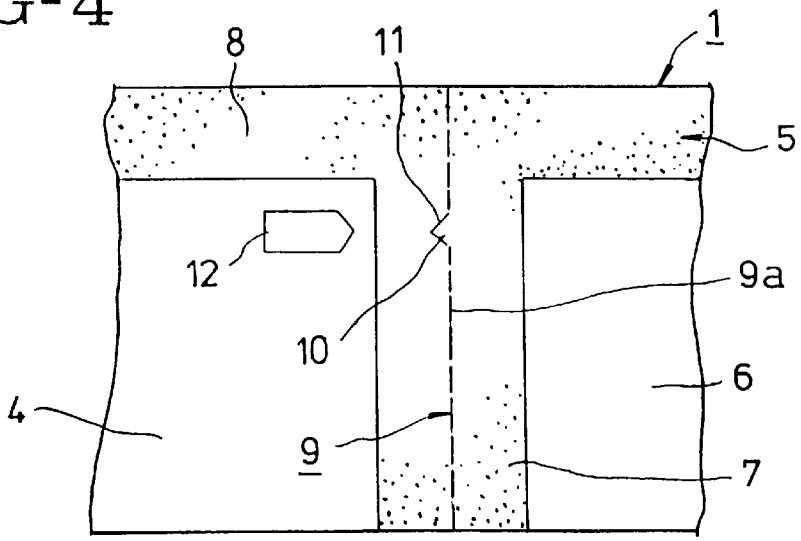
FIG. 4 is an enlarged partial plan view of the embodiment, showing a thermally welded section along which the related pouches are separated from each other.
Figure 5:
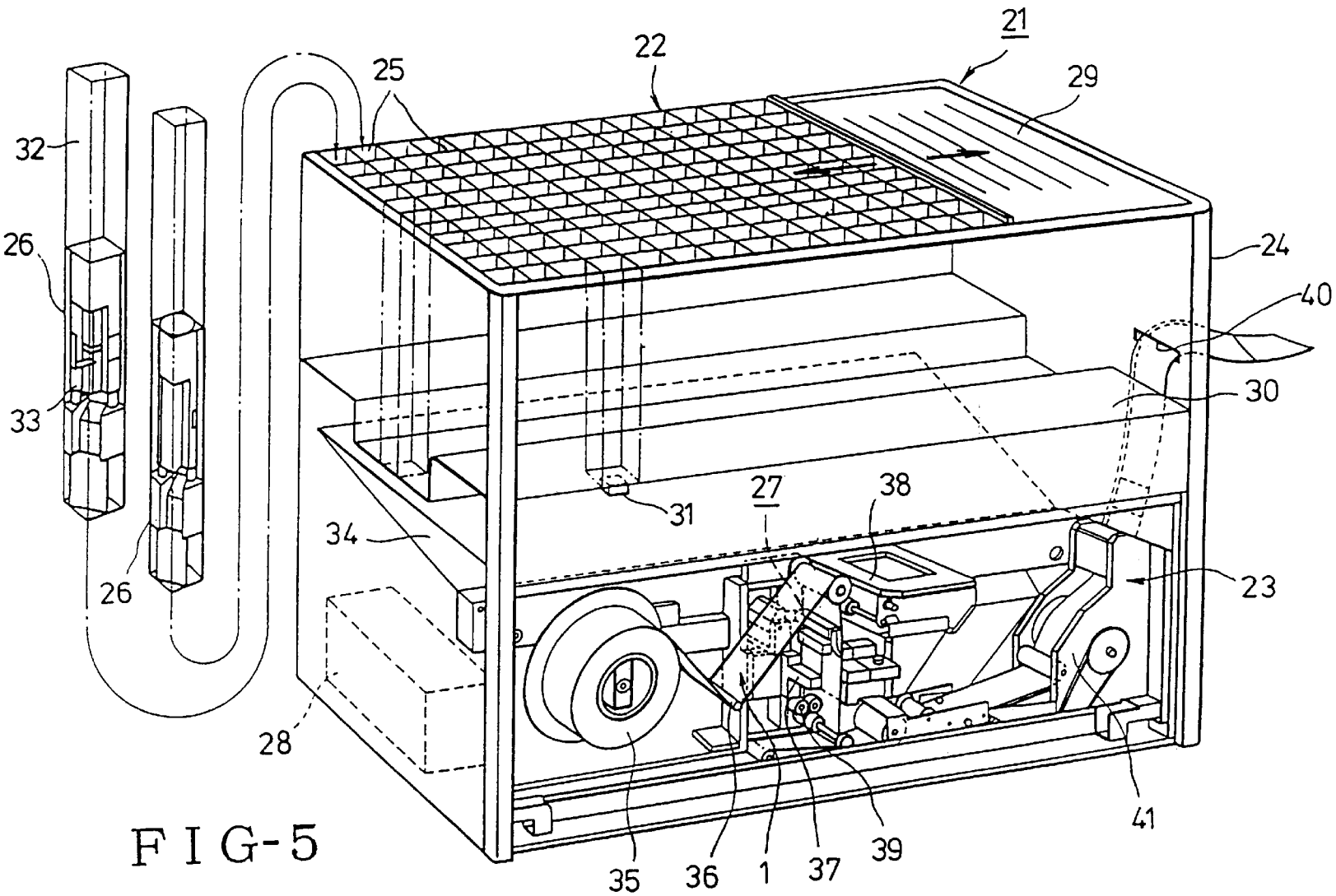
FIG. 5 is an exploded schematic perspective view of a tablet wrapping machine that can be used for the purpose of the invention.

FIG. 1 is a plan view of an oblong sheet of wrapping paper to be used for preparing an embodiment of pouches according to the invention. FIG. 2 is a plan view of the finished embodiment produced by longitudinally folding the sheet of wrapping paper to two halves and welding them. FIG. 3 is a partial cross sectional view of the embodiment, showing an principal area thereof. FIG. 4 is an enlarged partial plan view of the embodiment, showing a thermally welded section along which the related pouches are separated from each other. FIG. 5 is an exploded schematic perspective view of a tablet wrapping machine that can be used for the purpose of the invention.

Reference numeral 1 denotes an oblong wrapping paper comprising a polypropylene layer 2, a polyethylene layer 3 arranged on a surface of said polypropylene layer 2 and a white printable outer layer 4 coated and arranged on the other surface of said polypropylene layer as shown in FIG. 3.

The oblong wrapping paper 1 is longitudinally folded into two halves with the polyethylene layer 3 facing the inside and then thermally welded to produce pouches 6 defined by the respective thermally welded sections 5 as shown in FIG. 2. The thermally welded sections 5 comprise transversal thermally welded sections 7 that operate as partitions arranged at regular intervals to produce pouches 6 and a continuous and longitudinal thermally welded section 8 directly connected to the transversal thermally welded sections for sealing the pouches of the wrapping paper 1.

A straight perforation is formed along each of the transversal thermally welded sections 7 to make it easy to separate each pouch 6 from the rest. A slit 11 is formed along the perforation 9 with the bottom tip of V pointing a direction intersecting the perforation in order to produce a V-shaped notch 10 when the related pouches are separated from each other along the perforation. Note that the slit is arranged between a pair of successive unit openings 9*a* of the perforation 9 of the transversal thermally welded section 7. The notch 10 is located close to an end of the perforation 9 in the transversal thermally welded section 7 but separated from the longitudinal thermally welded section 8.

Reference numeral 12 denotes a guide mark printed on the outer layer 4, which may be printed characters signifying a notch and located close to the V-shaped notch 10 to indicate the direction along which the pouch is to be torn to take in the dose.

Reference numeral 21 generally denotes a tablet wrapping machine comprising a casing 24 containing an upper tablet storage section 22 and a lower wrapping station 23, a number of vertically oblong tablet cases 26 arranged in the respective openings of a grating 25 of the tablet storage section 22, a tablet feeding mechanism 27 for taking out a given number of tablets from an under side of selected tablet cases and feeding them into a pouch and a control unit 28 for controlling the operation of the tablet feeding mechanism 27 of taking out tablets from selected tablet cases 26 and feeding them into a pouch.

The casing 24 is provided with a horizontal sliding door 29 for covering the upper surface of the grating so that the grating 25 is exposed to allow access to the tablet cases 26 arranged in the grating when the sliding door is opened.

A stepped bottom plate 30 having a recessed central portion is arranged under the grating 25 and provided on the upper surface thereof with connectors 31 for receiving respective tablet cases 26. As one or more than one tablet cases 26 are inserted into the connectors 31, they are electrically connected to the control unit 28 to allow transmission and reception of signals such as drive signals and detection signals between them.

Each of the tablet cases 26 is realized in the form of a vertically oblong quadrangular hollow column and a tablet case main body 32 for storing tablets is arranged in an upper portion of the column whereas a mechanical unit 33 is arranged in a lower portion thereof.

Reference numeral 34 denotes a hopper having a substantially triangular cross section with high front and rear portions and a low central portion, said hopper being designed to lead the tablets taken out of the related tablet cases 26 to the central portion so that they may be thrown into a pouch by means of the tablet feeding mechanism 27.

The wrapping station 23 is provided with a roller 35 carrying a web of thermally weldable wrapping paper 1, a tension arm 36, a T-shaped heat sealing device 37 for producing transversal thermally welded sections 7 and a longitudinal thermally welded section 8 on a unit sheet of wrapping paper 1, a printer 38 for printing a predetermined statement including prescription data on each pouch 6, a feeding roller 39 for continuously feeding a series of sheet-like pouches 6 and a conveyor 41 for conveying the sheet-like pouches 6 to a pouch delivery port 40.

In pouches of wrapping paper for containing medical doses as constructed above, a unit sheet of wrapping paper comprises a polypropylene layer 2, a polyethylene layer 3 formed on a surface of the polypropylene layer, a white printable outer layer 4 coated on the other surface of the polypropylene layer, and the sheet of wrapping paper is then longitudinally folded into two halves and the polyethylene layer 3 is thermally welded together longitudinally and transversely to produce pouches for containing respective doses according to a prescription issued for a patient. A set of tablets taken out of selected tablet cases 26 are put into each pouch 6 by means of the feeding mechanism 27 of the wrapping station 23 of the tablet wrapping machine 21 before the pouches are completely sealed by thermal welding. The pouches are made separable by perforations 9 formed along the respective transversal thermally welded sections 7.

Since polypropylene that is not liable to be torn is used as the base material of pouches 6, each of the pouches is substantially free from the accident of an inadvertent tearing action that may take place when it is separated from the rest along the perforation 9. Additionally, if the pouch 6 is made to be torn only in a direction perpendicular to that of the perforation 9, the risk of inadvertently tearing the pouch 6 and causing the tablets contained there to fall down can be effectively minimized when it is separated from the rest along the perforation 9.

A V-shaped notch 10 is produced on each pouch 6 when it is separated from the remaining pouches along the perforation 9 by forming a corresponding V-shaped slit along the perforation between a pair of successive unit openings 9*a* of the perforation 9. The operation of tearing the pouch may be made even easier when a guide mark 12 is printed at a position close to the notch 10 to indicate the notch 10 and the direction along which the pouch 6 is torn. Since the notch 10 is located close to the leading end of the perforation 9, the pouch 6 can be opened by tearing off only a small portion of the pouch 6 to minimize the risk of inadvertently causing the tablets contained therein to fall down. The pouch 6 may be opened more surely and securely if the notch 10 is arranged out of the longitudinal thermally welded section 8.

Figure 6:
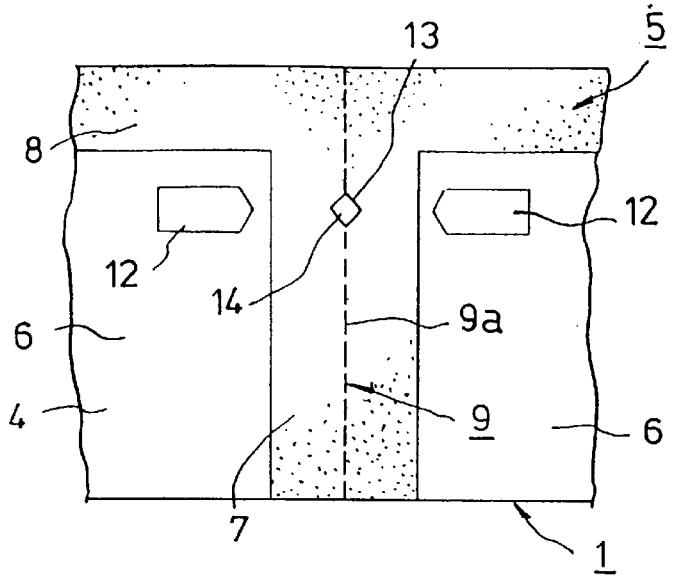
FIG. 6 is an enlarged partial plan view of another embodiment of the present invention, showing a thermally welded section along which the related pouches are separated from each other.

FIG. 6 of the accompanying drawings shows another embodiment of the invention, wherein a square slit 13 is formed and defined a cut-out opening between a pair of successive unit openings 9*a* of the perforation 9 so that V-shaped notches 14 perpendicular to the line of the perforation 9 are produced respectively on the related pouches 6 when they are separated from each other along the perforation 9. In other words, each of the pouches can be subsequently torn and opened from either side.

Figure 7:
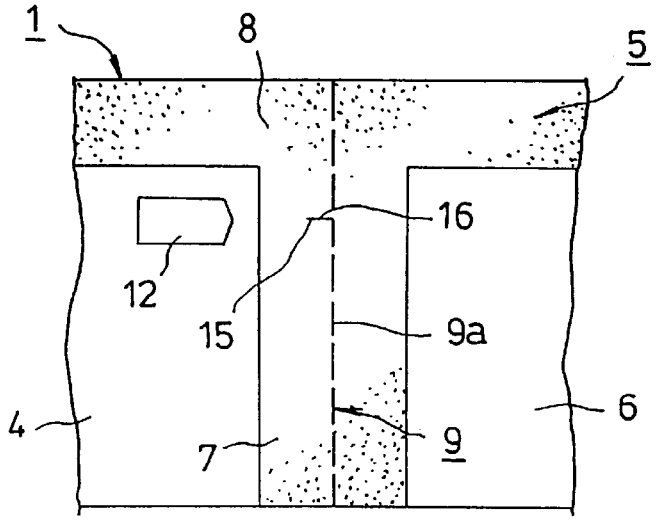
FIG. 7 is an enlarged partial plan view of furthermore another embodiment of the present invention, showing a thermally welded section along which the related pouches are separated from each other.

FIG. 7 of the accompanying drawings shows still another embodiment of the invention, wherein a linear slit 15 is formed between a pair of successive unit openings 9*a* of the perforation 9 in such a way that a slit-like notch 16 is produced on one of the related pouches 6 along a line intersecting the line of the perforation 9 when the pouches are separated from each other so that the notched pouch 6 may be subsequently torn and opened along a direction intersecting the line of the perforation 9.

Figure 8:
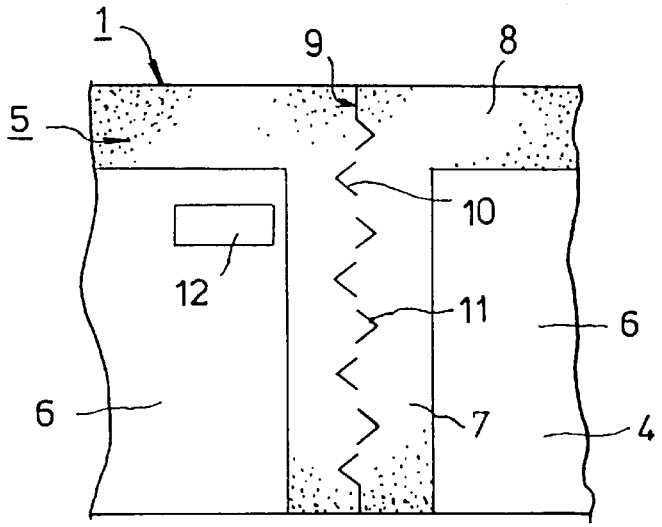
FIG. 8 is an enlarged partial plan view of another embodiment of the present invention, showing a thermally welded section along which the related pouches are separated from each other.

FIG. 8 of the accompanying drawings shows still another embodiment of the invention, wherein a perforation 9 comprising a combination of a number of V-shaped slits 11 is formed in each transversal thermally welded section 7 for separating the related pouches 6.

The V-shaped slits 11 are arranged alternately in opposite directions to show a zigzag line, although the opposite end portions of the perforation are parallel to the direction of the transversal perforation 7.

With the above arrangement, when the related pouches 6 are separated from each other along the perforation 9 of the transversal thermally welded section 7, each of the pouches 6 comes to show a number of V-shaped notches 10 that are arranged continuously so that it may be torn and opened from any position in a direction perpendicular to that of the transversal thermally welded section 7.

When the pouches 6 arranged at the opposite sides of a transversal thermally welded section 7 having a zigzag perforation 9 are separated from each other, the wrapping paper 1 between any pair of V-shaped unit slits 11 is torn linearly so that the transversal thermally welded section 7 may not be torn far away from the perforation 9.

In short, according to the invention, there are provided pouches of wrapping paper for containing doses, wherein the wrapping paper is formed by using polypropylene as a base material to make it hardly torn and perforations 9 are formed in such a way that the direction along which the leading pouch is separated from the rest intersects the direction along which it is torn and opened so that it may not be inadvertently torn when it is separated from the remaining pouches.

While the slits 11, 13 and 15 for forming notches 10, 14 and 16 are described respectively as V-shaped, square and linear slits above, they may alternatively have any appropriate shapes including the shape of a star.

INDUSTRIAL APPLICABILITY

According to an aspect of the invention, since there are provided pouches of wrapping paper for containing medicinal doses, wherein an oblong sheet of polypropylene is folded longitudinally into two halves, thermally welded along transversal partitioning edges to produce a series of pouches for containing doses and perforated along the thermally welded transversal edges of the pouches and each of the pouches is provided with a torn portion for tearing it along a direction intersecting the perforation formed along a thermally welded transversal edge of the pouch to define the line of separation thereof, it can be separated along the perforation without the risk of tearing the pouch itself in the direction of the perforation. In other words, each pouch has a direction of separation and another direction of tearing so that any power forcing the pouch to be torn is not applied when it is separated from the rest along the perforation.

According to another aspect of the invention, since there are also provided pouches of wrapping paper for containing medicinal doses of the above described type, wherein each of the pouches is provided with a torn portion for tearing it along a direction intersecting the perforation formed along a thermally welded transversal edge of the pouch to define the line of separation thereof at a position displaced from the center of the line of separation, the pouch may be torn from a position close to an edge thereof and the dose contained in the pouch may not fall out when it is torn.

According to still another aspect of the invention, since there are provided pouches of wrapping paper for containing medicinal doses, wherein an oblong sheet is perforated along thermally welded transversal edges and each of the pouches is provided with a V-shaped or a linear slit for tearing it along a direction intersecting the perforation formed along each thermally welded transversal edge of the pouch to define the line of separation thereof, notch is formed as the pouch is separated from the rest along the perforation in order to make it even easier to tear the pouch.

According to still another aspect of the invention, since there are provided pouches of wrapping paper for containing medicinal doses, wherein an oblong sheet is perforated along thermally welded transversal edges and each of the pouches is provided with a torn portion for tearing it along a direction intersecting the perforation formed along each thermally welded transversal edge of the pouch to define the line of separation thereof and a guide mark printed close to the torn portion for leading a tearing action, the patient may surely tear the pouch along a direction intersecting the perforation.

According to a still further aspect of the invention, since there are provided pouches of wrapping paper for containing medicinal doses, wherein an oblong sheet of polypropylene is folded longitudinally into two halves, thermally welded along transversal partitioning edges to produce a series of pouches for containing doses and perforated along the thermally welded transversal edges of the pouches and the perforation of each of the pouches shows a zigzag line formed as a combination of V-shaped sections, a number of continuously arranged V-shaped notches are formed simply by separating the leading pouch from the rest so that it can be torn and opened with ease once separated from the rest, although it is hardly torn when it is separated from rest.

We claim:

1. A strip of pouches for containing medicinal doses, comprising an oblong sheet of thermoplastic material folded longitudinally into two parts and thermally welded along a plurality of parallel spaced partitioning sections transverse to the longitudinal fold to form a series of pouches, each for respectively containing a medicinal dose and thermally welded along the edges of the folded sheet to seal the pouches, said strip being perforated along a separation line of the thermally welded partitioning sections transverse to the longitudinal fold and thermally welded edge, the separation line of each of the pouches being provided with a pair of said V-shaped slits with the tips of the V arms being opposed at said separation line and the apex of each of the slits of said pair pointing in opposite directions from said separation line.

2. A strip as in claim 1 wherein the thermoplastic material between said pair of opposing V-shaped slits is removed to form a generally square cut-out.

3. A strip of pouches as in claim 1, wherein said separation line of perforations has at least one linear slit transverse to said longitudinal fold between the edge of the strip and the tip of the nearest arm of the V-shaped slits.

4. A strip as in claim 2 wherein the tips of the V's of the pair of opposing V-shaped slits are engaging on said separation line.

5. A strip as in claim 2 further comprising at least one linear slit on said separation line of perforations between an edge of the strip and the juncture of one tip of each of the pair of V-shaped strips.

6. A strip as in claim 2 further comprising a plurality of linear slits between the junctions of the other tip of each of the pair of V-shaped slits extending toward the other edge of said strip.

7. A strip of pouches for containing medicinal doses, comprising an oblong sheet of thermoplastic material folded longitudinally into two parts and thermally welded along a plurality of parallel spaced partitioning sections transverse to the longitudinal fold to form a series of pouches, each pouch being arranged for respectively containing a medicinal dose and thermally welded along the edges of the folded sheet to seal the pouches, said strip being perforated along a separation line of the thermally welded partitioning sections transverse to the longitudinal fold and thermally welded edge, the separation line of each of the pouches being provided with a cut out opening, and at least one linear slit along said separation line from one edge of the strip to the closest point of said cut out opening on said separation line.

8. A strip of pouches as in claim 7 further comprising a plurality of linear slits along said separation line from a point of said opening opposite said opening closest point to near the other edge of the strip.

9. A strip as in claim 8 wherein said opening is rectangular with a corner of the rectangle at said closest point and opposite point.

* * * * *